United States Patent [19]

Hetzel

[11] Patent Number: 4,575,953

[45] Date of Patent: Mar. 18, 1986

[54] SAFETY SHOE WITH TOE PROTECTING CAP

[76] Inventor: Gerhard Hetzel, Zeilhofweg 50, 7104 Obersulm 2, Fed. Rep. of Germany

[21] Appl. No.: 588,714

[22] Filed: Mar. 12, 1984

[30] Foreign Application Priority Data

Mar. 10, 1983 [DE] Fed. Rep. of Germany ..... 3308511

[51] Int. Cl.[4] ..... A43C 13/14

[52] U.S. Cl. ..... 36/77 R; 36/72 R

[58] Field of Search ..... 36/77 R, 77 M, 72 R, 36/68, 69, 24.5, 12

[56] References Cited

U.S. PATENT DOCUMENTS

| | | | |
|---|---|---|---|
| 1,293,217 | 2/1919 | Shaft | 36/68 |
| 1,941,853 | 1/1934 | Colavito et al. | 36/68 |
| 2,328,601 | 9/1943 | Baird | 36/77 R |
| 2,483,520 | 10/1949 | Blake | 36/68 |
| 2,740,209 | 4/1956 | Shultz | 36/77 R |
| 3,270,358 | 9/1966 | Milner | 36/77 R |

FOREIGN PATENT DOCUMENTS

| | | | |
|---|---|---|---|
| 751318 | 8/1933 | France | 36/12 |
| 1110738 | 2/1956 | France | 36/12 |
| 81294 | 7/1963 | France | 36/77 R |

*Primary Examiner*—Werner H. Schroeder
*Assistant Examiner*—Mary A. Ellis
*Attorney, Agent, or Firm*—Thomas W. Speckman

[57] ABSTRACT

A safety shoe having a toe protecting cap which is shaped to conform substantially to the tip of the shoe and is provided at its portion facing the sole of the shoe with an inwardly directed flanged rim. This toe protecting cap flanged rim is inserted into a groove provided in the vertical end face of the one piece sole and is retained therein by attachment of the upper of the shoe, whereby the upper groove wall is set back with respect to the lower groove wall by at least the thickness of the toe protecting cap. The shoe upper is attached to the lower groove wall. The manufacture of the safety shoe is simplified and production cost savings are realized by providing a one piece sole having a groove therein, whereby at least one of the height and depth of the groove is slightly less than the corresponding thickness and length of the flanged rim of the toe protecting cap. The flanged rim of the toe protecting cap is tightly inserted into the groove in the one piece sole until it bears against the front face of the upper groove wall so that the toe protecting cap is retained immovably in the groove.

15 Claims, 3 Drawing Figures

FIG. 1
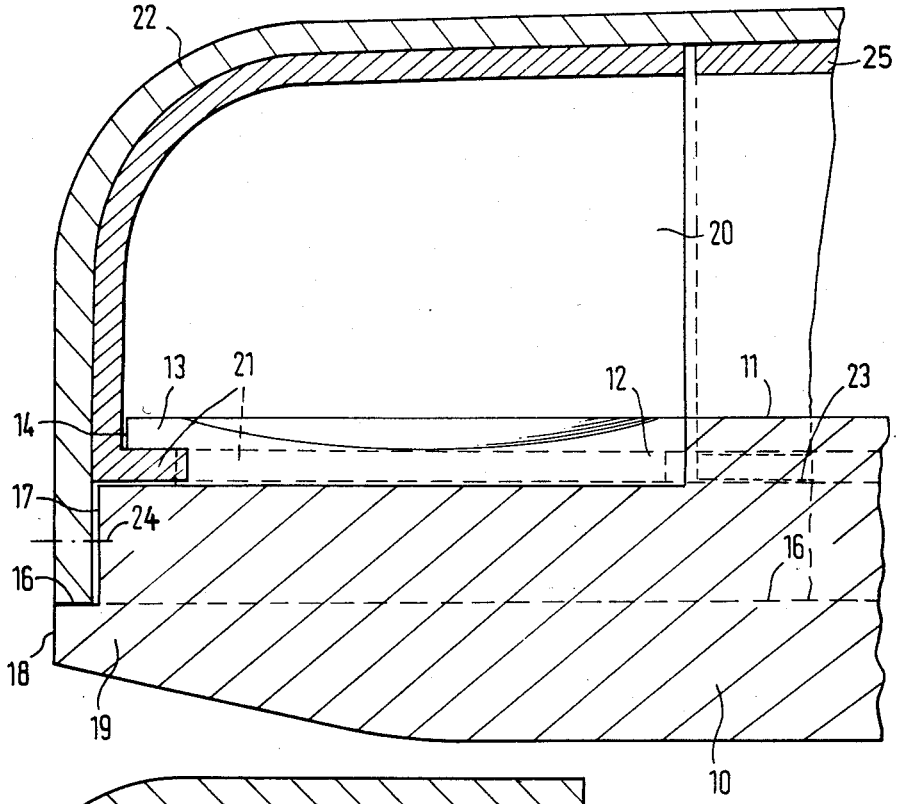
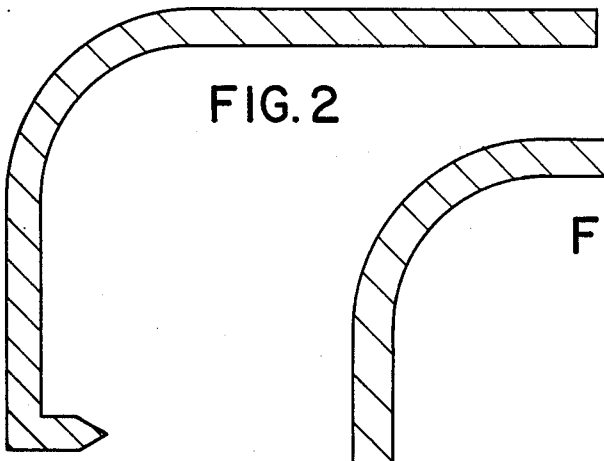
FIG. 2
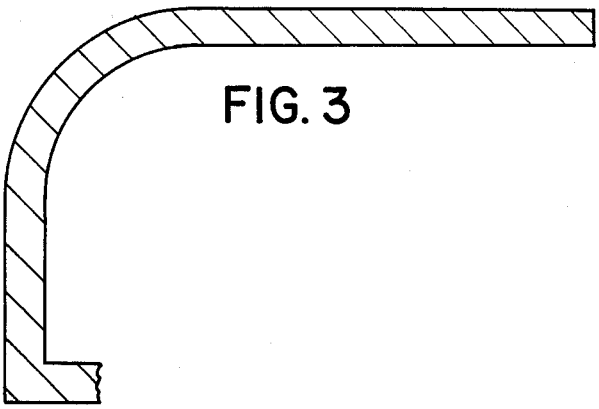
FIG. 3

SAFETY SHOE WITH TOE PROTECTING CAP

BACKGROUND OF THE INVENTION

1. Field of the Invention

The present invention relates to a safety shoe having a toe protecting cap which is shaped to substantially conform to the tip of the shoe and is provided at its portion facing the sole of the shoe with an inwardly directed flanged rim. The flanged rim of the toe protecting cap is inserted into a groove provided in the vertical end face of the sole and is retained therein by attachment of the shoe upper whereby the upper groove wall is set back with respect to the lower groove wall by at least the thickness of the toe protecting cap, and the shoe upper is joined to the lower groove wall.

2. Description of the Prior Art

A safety shoe of this general type is known from German Patent Publication DE-OS No. 23 40 146. It has the advantage that the toe protecting cap, which is conventionally made of metal, does not require separate fastening means to be attached to the sole. The flanged rim of the toe protecting cap firmly holds the toe protecting cap in a groove perpendicular to the underside of the sole, and the toe protecting cap is permanently secured to the sole by the shoe upper which is subsequently attached to the sole.

In this prior safety shoe, the sole is composed of a lower portion and an upper portion. The upper edge of the lower portion is provided with an offset over which the upper section projects to form the groove for the flanged rim of the toe protecting cap. This double sole increases the production costs of the safety shoe. Another disadvantage of this prior safety shoe is that the toe protecting cap, even after the attachment of the shoe upper, tends to move within the groove rather than being fixed. Furthermore, the toe cap must be held fast as the shoe upper is being attached to the sole and this complicates the manufacture of the safety shoe at least in the early stages.

SUMMARY OF THE INVENTION

An object of the present invention is to improve the safety shoe of the type referred to above, the improvements residing in that the metal cap is constructed to be attached to the sole, without requiring additional fastening means, before the shoe upper is attached to the sole, such that the metal plate is prevented from executing any movement in the groove, and that it need not be supported during the operation of attaching the shoe upper to the sole, all to simplify and ease production of the safety shoe, as compared to the prior multistage fabrication methods.

This object is achieved according to the invention in that a groove is provided in the one piece sole, that at least one of the height and depth of the groove is slightly less than the corresponding thickness and length of the flanged rim of the toe protecting cap, and that the toe protecting cap is tightly inserted by its flanged rim into the groove provided in the one piece sole until the toe protecting cap bears against the front face of the upper groove wall so that the toe protecting cap is retained immovably in the groove.

The groove may be provided in a one piece sole which is conventional and commercially available during the manufacturing process by molding, in the case of a plastic sole for example, or the groove may be milled in a wooden sole or the like, and in either case attention must be paid to the precision of the measurements.

This is achieved in the simplest manner in that the groove, having an upper groove wall and an offset portion at the lower groove wall, is made with a correspondingly formed mold or a suitable milling cutter with one operation in the vertical end surface of the one piece sole. The toe protecting cap may then be forced into the grooved one piece sole like a track, with the groove walls acting like a clamp on the flanged rim of the toe protecting cap and the groove base experiencing some degree of deformation due to the flanged rim. When the toe protecting cap has been inserted a distance until it abuts the front face of the upper groove wall, the cap is held sufficiently securely on the one piece sole and is prevented from inadvertent detachment during subsequent operations, especially when the shoe upper is attached to the sole. Individual operations during the manufacture of a safety shoe according to the present invention are much easier to execute than operations in the manufacturing process of the prior art safety shoe and this is reflected in lower production costs.

According to one embodiment of the invention, the lower groove wall is provided with a frontal shoulder or offset portion at the end facing the toe protecting cap. The vertical extending section of this offset is flush with the outer surface of the toe protecting cap, so that the shoe upper can be directly attached to the vertical section of this offset portion on the lower groove wall, without requiring the lower edge of the shoe upper to be folded. This feature is likewise cost saving to the manufacturing process.

The insertion of the flanged rim of the toe protecting cap into the groove is achieved according to another embodiment, in that the flanged rim is pointed.

The same objective is achieved according to yet another embodiment in which the flanged rim is saw-toothed, with the points of the teeth angularly directed for insertion lengthwise into the grooved one piece sole.

To ensure that the space enclosed by the toe protecting cap is optimally designed for roomy comfort of the toes, another embodiment provides that the vertical dimension of the upper groove wall corresponds approximately to the thickness of a preferably anatomically contoured upper sole surface. The upper groove wall is of sufficiently stability to withstand the strain occurring during the insertion of the toe protecting cap into the groove of the one piece sole.

To obtain a sufficiently large surface area for the attachment of the shoe upper to the one piece sole, the vertically extending section of the offset portion provided at the lower groove wall is approximately 10 mm wide.

A clean finish of the safety shoe at the tip of the sole is achieved according to another embodiment in that the lower groove wall, below the offset portion, is flush with the outer surface of the shoe upper attached to the vertically extending section of the lower groove wall.

To impart increased stability to the safety shoe in the region of the middle foot, yet another embodiment provides that the groove in the one piece sole extends toward the middle section of the one piece sole to receive a middle foot protecting cap before the toe protecting cap is fastened in the groove.

To attach the shoe upper along its entire length to the outer surface of the one piece sole at a somewhat lower level, another embodiment provides that the vertically extending section of the offset portion extends below the groove for a distance corresponding to the entire length of the shoe upper available for attachment.

BRIEF DESCRIPTION OF THE DRAWINGS

The invention will be further described with reference to embodiments illustrated in the figures:

FIG. 1 shows a sectional view of one embodiment of the tip of a safety shoe having a toe protecting cap;

FIG. 2 shows a sectional view of another embodiment of a toe protecting cap according to this invention; and FIG. 3 shows a sectional view of another embodiment of a toe protecting cap according to this invention.

DESCRIPTION OF THE PREFERRED EMBODIMENTS

The sole used may be a one piece sole or wooden sole 10, the upper surface 11 of which is contoured to fit the anatomical shape of the foot and the lower walking surface may be made skid-resistant by appropriate means. Toe protecting cap, or toe box cap, 20 is likewise conventional and commercially available and determines the amount of space allowed for the toes. Toe protecting cap 20 is preferably made of metal or some other similarly firm material. The lower edge of toe protecting cap 20 is turned inwardly at a right angle and terminates in flanged rim 21. The shape of wooden sole 10 and toe protecting cap 20 are mutually compatible. At the top of the sole, groove 12 is milled into the vertical outer surface of wooden sole 10, producing upper groove wall 13 separate from lower groove wall 19. At least one of the height and depth of groove 12 is selected to be slightly less than the corresponding thickness and length of flanged rim 21 of toe protecting cap 20. In addition, upper groove wall 13 is set back at its front end by an amount equal to the thickness of toe protecting cap 20, as indicated by front face 14. Flanged rim 21 of toe protecting cap 20 is inserted into groove 12 and is advanced into wooden sole 10 at a distance until it bears against front face 14 of upper groove wall 13. This has the effect that flanged rim 21 is clamped between upper groove wall 13 and lower groove wall 19, and may be forced into the groove base, depending on the height and depth of groove 12. In any event, toe protecting cap 20, thusly attached to wooden sole 10, is positively retained thereon without needing additional fastening means. When shoe upper 22 is subsequently attached, toe protecting cap 20 need not be supported or held, so that subsequent operational steps are substantially simplified and eased compared to operations required in the manufacture of the prior safety shoe. One embodiment provides that the vertical dimension of upper groove wall 13 corresponds approximately to the depth of a preferably anatomically contoured upper sole surface 11.

Lower groove wall 19 is provided at its front end with offset portion 16 extending parallel to and offset a distance below groove 12, vertically extending section 17 which is flush with the outer surface of toe protecting cap 20 inserted in groove 12. Shoe upper 22 can therefore be directly attached to vertically extending section 17 of offset portion 16, without necessitating bending or turning in at its lower edge, as indicated by fastening means 24. Front face 18 of lower groove wall 19, which is not covered by shoe upper 22, is flush with the outer surface of shoe upper 22 attached to wooden sole 10.

Offset portion 16 including vertically extending section 17 projects beyond groove 12 and constitutes an attachment surface area for entire shoe upper 22. The particular type of shoe upper 22 is discretionary and has no bearing on the mode of attachment of toe protecting cap 20, as long as groove 12, including upper groove wall 13 and lower groove wall 19, is properly constructed. In one embodiment, groove 12 may be provided with an extension 23 extending toward the middle section of the one piece sole to receive and secure a middle foot protecting cap before toe protecting cap 20 is fastened in groove 12.

I claim:

1. Safety shoe comprising a toe protecting cap (20) shaped to conform substantially to the tip of said shoe and provided at its portion facing the sole of said shoe with an inwardly directed flanged rim (21) which is inserted into a groove (12) provided in the vertical end face of a one piece sole (10) and is retained therein by the upper (22) of said shoe, an upper groove wall (13) being set back with respect to a lower groove wall (19) by at least the thickness of said toe protecting cap (20), said lower grove wall (19) provided with an offset portion (16) at the end facing said toe protecting cap (20) extending parallel to and offset a distance from said groove (12) and said shoe upper (22) being attached to a vertically extending section (17) of said lower groove wall (19) which is flush with the outer surface of said toe protecting cap (20), a front face (18) of said lower groove wall (19) being flush with the outer surface of said shoe upper (22) attached to said vertically extending section (17), said one piece sole (10) is provided with said groove (12) therein and that at least one of the height and depth of said groove (12) is slightly less than the corresponding thickness and length of said flanged rim (21) of said toe protecting cap (20) and said flanged rim (21) of said toe protecting cap (20) is tightly inserted into said groove (12) provided in said one piece sole (10) until said toe protecting cap (20) bears against a front face (14) of said upper groove wall (13) so that said toe protecting cap is retained immovably in said groove (12).

2. Safety shoe according to claim 1, characterized in that said toe protecting cap (20) is made of metal.

3. Safety shoe according to claim 1, characterized in that said flanged rim (21) of said toe protecting cap (20) is pointed.

4. Safety shoe according to claim 1, characterized in that said flanged rim (21) has a saw-toothed edge with the points of the teeth angularly directed to allow lengthwise insertion into the groove base of said one piece sole (10).

5. Safety shoe according to claim 1, characterized in that the vertical dimension of said upper groove wall (13) corresponds approximately to the thickness of a preferably anatomically contoured upper sole surface (11).

6. Safety shoe according to claim 1, characterized in that said vertically extending section (17) of said offset portion (16) projects below said groove (12) for at least the entire length of said upper (22) available for attachment.

7. Safety shoe according to claim 1, characterized in that said vertically extending section (17) of said offset portion (16) extending parallel to and offset a distance from said groove (12) provided at said lower groove wall (19) has a width of approximately 10 mm.

8. Safety shoe according to claim 1, characterized in that front face (18) of said lower groove wall (19) is flush with the outer surface of said shoe upper (22) attached to said vertically extending section (17) of said lower groove wall (19).

9. Safety shoe according to claim 2, characterized in that said flanged rim (21) of said toe protecting cap (20) is pointed.

10. Safety shoe according to claim 2, characterized in that said flanged rim (21) has a saw-toothed edge with the points of the teeth angularly directed to allow lengthwise insertion into the groove base of said one piece sole (10).

11. Safety shoe according to claim 10, characterized in that the vertical dimension of said upper groove wall (13) corresponds approximately to the thickness of a preferably anatomically contoured upper sole surface (11).

12. Safety shoe according to claim 11, characterized in that said vertically extending section (17) of said offset portion (16) provided at said lower groove wall (19) has a width of approximately 10 mm.

13. Safety shoe according to claim 11 characterized in that said vertically extending section (17) of said offset portion (16) projects below said groove (12) for at least the entire length of said upper (22) available for attachment.

14. Safety shoe comprising a metal toe protecting cap (20) shaped to conform substantially to the tip of said shoe and provided at its portion facing the sole of said shoe with an inwardly directed flanged rim (21) having a saw-toothed edge with the points of the teeth angularly directed which is inserted lengthwise into a groove (12) provided in the vertical end face of a one piece sole (10) and is retained therein by the upper (22) of said shoe, an upper groove wall (13) being set back with respect to a lower groove wall (19) by at least the thickness of said toe protecting cap (20), the vertical dimension of said upper groove wall (13) corresponding approximately to the depth of a preferably anatomically contoured upper sole surface (11), said lower groove wall (19) provided with an offset portion (16) at the end facing said toe protecting cap (20) extending parallel to and offset a distance from said groove (12) and said shoe upper (22) being attached to a vertically extending section (17) of said lower groove wall (19) which is flush with the outer surface of said toe protecting cap (20) and has a width of approximately 10 mm, a front face (18) of said lower groove wall (19) being flush with the outer surface of said shoe upper (22) attached to said vertically extending section (17), said one piece sole (10) is provided with said groove (12) therein and at least one of the height and depth of said groove (12) is slightly less than the corresponding thickness and length of said flanged rim (21) of said toe protecting cap (20) and said flanged rim (21) of said toe protecting cap (20) is tightly inserted into said groove (12) provided in said one piece sole (10) until said toe protecting cap (20) bears against a front face (14) of said upper groove wall (13) so that said toe protecting cap is retained immovably in said groove (12), and said groove (12) has a lateral extension (23) pointing toward the arch portion of said one piece sole (10) to receive a middle foot protecting cap (25) before said toe protecting cap (20) is fastened in said groove (12).

15. Safety shoe comprising a toe protecting cap (20) shaped to conform substantially to the tip of said shoe and provided at its portion facing the sole of said shoe with an inwardly directed flanged rim (21) which is inserted into a groove (12) provided in the vertical end face of a one piece sole (10) and is retained therein by the upper (22) of said shoe, an upper groove wall (13) being set back with respect to a lower groove wall (19) by at least the thickness of said toe protecting cap (20), and said shoe upper (22) being attached to a vertically extending section (17) of said lower groove wall (19), said one piece sole (10) is provided with said groove (12) therein and at least one of the height and depth of said groove (12) is slightly less than the corresponding thickness and length of said flanged rim (21) of said toe protecting cap (20) and said flanged rim (21) of said toe protecting cap (20) is tightly inserted into said groove (12) provided in said one piece sole (10) until said toe protecting cap (20) bears against a front face (14) of said upper groove wall (13) so that said toe protecting cap is retained immovably in said groove (12), and said groove (12) has a lateral extension (23) pointing toward the arch portion of said one piece sole (10) to receive a middle foot protecting cap (25) before said toe protecting cap (20) is fastened in said groove (12).

* * * * *